US005931005A

United States Patent [19]

Garrett et al.

[11] Patent Number: 5,931,005

[45] Date of Patent: Aug. 3, 1999

[54] FLUID CHILLING APPARATUS

[75] Inventors: Michael E. Garrett, Woking; Evelyn A. Shervington, South Harting, both of United Kingdom

[73] Assignee: The BOC Group plc (An English Company), Windlesham, United Kingdom

[21] Appl. No.: 09/002,478

[22] Filed: Jan. 2, 1998

[30] Foreign Application Priority Data

Jan. 8, 1997 [GB] United Kingdom ..... 9700238
Aug. 7, 1997 [GB] United Kingdom ..... 9718815

[51] Int. Cl.[6] ..... F25B 9/00; F25D 3/08; F25D 3/10

[52] U.S. Cl. ..... 62/86; 62/480; 62/530; 62/294

[58] Field of Search ..... 62/4, 60, 86, 271, 62/293, 294, 337, 371, 372, 480, 530

[56] References Cited

U.S. PATENT DOCUMENTS 4,993,239 2/1991 Steidl et al. ..... 62/480
5,384,101 1/1995 Rockenfeller ..... 422/211
5,388,637 2/1995 Jones et al. ..... 165/104.12
5,447,039 9/1995 Allison ..... 62/293
5,692,381 12/1997 Garrett ..... 62/60
5,704,222 1/1998 Hage et al. ..... 62/293

*Primary Examiner*—William Doerrler
*Attorney, Agent, or Firm*—William A. Schoneman; Salvatore P. Pace

[57] ABSTRACT

A chiller for chilling a quantity of fluid of the type comprising an adsorbent for receiving and adsorbing under pressure a quantity of gas, the desorption of gas from the adsorption causing a reduction in temperature of the adsorbent and adsorbate which acts to chill the fluid, wherein the chiller comprises one or more thin-walled vessels for placement in direct thermal contact with the fluid to be chilled, each vessel comprising two thin sheets of substantially similar size and shape, joined together around the peripheral edges thereof so as to form a cavity therebetween for containing the adsorbent. Preferably, heat transfer means are provided to ensure efficient transfer of heat between the surface of the body of adsorbent and the adsorbent therewithin.

24 Claims, 6 Drawing Sheets

FLUID CHILLING APPARATUS

This invention relates to an apparatus for chilling fluids, particularly but not exclusively canned or bottled beverages.

BACKGROUND OF THE INVENTION

The present invention is directed towards a fluid chilling apparatus of the type in which the temperature reduction caused by the desorption of a gas from an adsorbent is used to chill a beverage, such as is disclosed in European patent application number 0752564.

There is a requirement for a chilling apparatus for chilling canned or bottled beverages which necessitates no more than minimal changes to existing beverage containers. Major manufacturers also require that a chilling apparatus not necessitate major changes to existing production lines. These requirements are addressed in accordance with the present invention.

SUMMARY OF THE INVENTION

In accordance with the present invention, there is provided a chiller for chilling a quantity of fluid of the type comprising an adsorbent for receiving and adsorbing under pressure a quantity of gas, the desorption of gas from the adsorbent causing a reduction in temperature of the adsorbent and adsorbate which acts to chill the fluid, wherein the chiller comprises at least one thin-walled vessel for placement in direct thermal contact with the fluid to be chilled and wherein the or each vessel comprises two thin sheets of substantially similar size and shape, joined together around the peripheral edges thereof so as to form a cavity therebetween for containing the adsorbent.

DETAILED DESCRIPTION OF THE INVENTION

Figure 1:
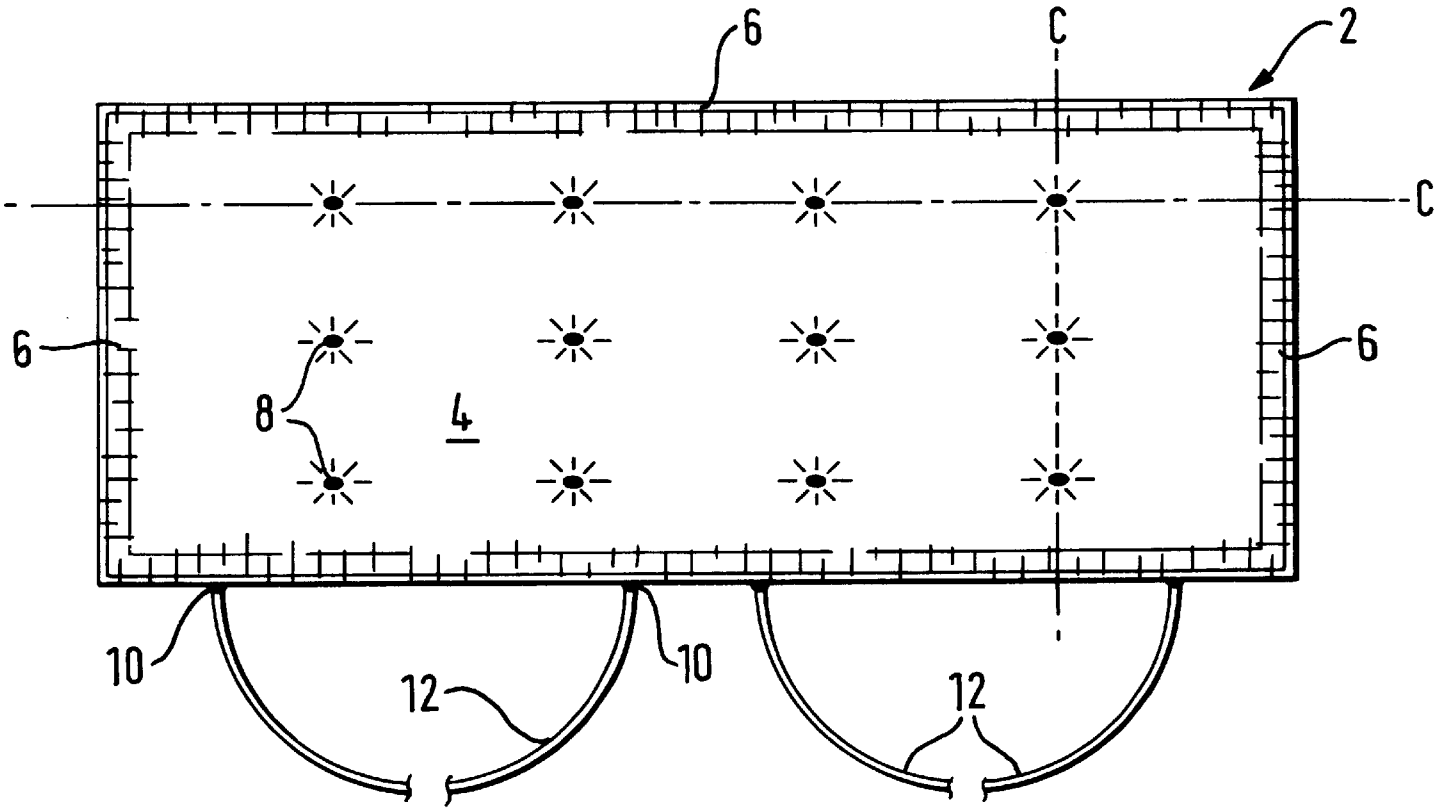
FIG. 1 is a diagrammatic view of a first embodiment of a chiller in accordance with the present invention.

It is known that most adsorbents are poor conductors of thermal energy. As a result, the chilling of a typical amount of a beverage can be slow, often unacceptably so for a thirsty person, due to poor heat transfer to the adsorbent in the center of the body of adsorbent contained in the chiller. Accordingly, the present invention provides a chiller for chilling a quantity of fluid of the type comprising an adsorbent for receiving and adsorbing under pressure a quantity of gas, the desorption of gas from the adsorbent causing a reduction in temperature of the adsorbent and of the desorbed gas, which temperature reduction acts to chill the fluid, wherein the chiller comprises at least one thin-walled vessel containing the adsorbent and for placement in direct thermal contact with the fluid to be chilled and heat transfer means of thermally-conductive material in direct thermal contact with the adsorbent and adapted to transfer heat between the vessel walls and the adsorbent therein.

With such an arrangement, the heat transfer means can speed up the transfer of heat into the center of a body of adsorbent therefore more effectively exploiting the effect of the temperature reduction caused by desorption of gas therefrom, and providing more rapid chilling of a given quantity of fluid. The vessel is advantageously comprised of two thin sheets of substantially similar size and shape joined together at the peripheral edges to form a cavity for retaining the adsorbent.

Advantageously, the sheets, which may be planar, are resiliently deformable, in order that the chiller vessel can be inserted through the neck of a bottle, or the dispensing aperture of a beverage can. The sheets may suitably be made of aluminum or an alloy thereof, which sheets can be easily welded together along their peripheral edges. Alternatively, the vessel may comprise a layer of phenolic resin glass coating applied so as to surround the adsorbent.

The sheets forming the chiller vessel may also be joined together, by spot welding, for example, at one or more points other than around their peripheral edges. Such an arrangement provides not only a stronger chiller vessel construction but also an increase in surface area. Moreover, these additional joining points may be aligned so as to form crease lines about which the chiller vessel may be folded, so as to facilitate insertion thereof into a beverage container.

Preferably, the chiller of the present invention further comprises one or more elongate tubes, the or each tube communicating at one end with the vessel cavity and the adsorbent therein, thereby to create a passageway for adsorbed gas to pass through as it is released from the adsorbent. The or each elongate tube allows heat transfer from the beverage or other fluid to the gas flowing along its length, which is suitably substantially longer than the maximum dimension of the vessel; this latter feature enables the elongate tube(s) to be wound around a resiliently deformable vessel so as to hold it in a tightly-squeezed configuration for easy insertion into a beverage container, and/or to be disposed in the container so as to pass from the distal part thereof, i.e. from the point furthest from the dispensing aperture, to the dispensing aperture, thus passing through, and chilling, a significant proportion of the fluid therein. To maximize the chilling effect provided by the subject chiller, thermally-conductive fins may also be provided, extending from one or both of the sheets forming the chiller vessel.

The chiller provided in accordance with the present invention is particularly advantageous in that it is easily introduced into beverage containers without requiring the major redesign of those containers or of the production lines therefor. The chillers provided herein are also simple, inexpensive and easy to fabricate. In addition, the chiller vessels have a large surface area in relation to their volume which optimizes their chilling efficiency. As a result, the volume of such a chiller vessel can be minimized, so that it does not displace any greater volume of beverage than is strictly necessary to achieve the desired chilling effect.

Suitably, the adsorbent contained in the chiller provided in accordance with the present invention is in particulate form, particulate activated carbon for example, which is packed, or compressed, so as to minimize the volume occupied by the adsorbent so far as is consistent with maintaining a substantially porous structure to allow ready desorption of gas, carbon dioxide in the case where the adsorbent is activated carbon, from the adsorbent in the inner regions of the body of adsorbent.

Where the adsorbent is particulate, the heat transfer means is preferably also in particulate form, the heat transfer particles being of substantially different average size from the average size of the adsorbent particles. Such a composition is particularly advantageous because, where the heat transfer particles are substantially larger than the adsorbent particles, the heat transfer particles pack together in an array and the adsorbent particles fit into the interstices between adjacent heat transfer particles. In this way, a compact, porous structure can be created in which there is a plurality of effective heat transfer paths between the body of adsorbent and the outer surface thereof. Suitably, the heat transfer particles are substantially evenly dispersed through the adsorbent, so as to create a largely homogenous body of adsorbent and heat transfer particles, and are formed of aluminum or an alloy thereof.

Additionally or alternatively, the heat transfer means may comprise a resilient sheet of thermally-conductive material sized, configured and disposed so as, when placed within the thin-walled vessel, to be contiguous with the walls of the vessel over at least a part of its surface area. With such an arrangement, the sheet provides a good heat transfer path between the outer walls of the vessel containing the adsorbent and the interior of the adsorbent.

In a particularly simple and inexpensive embodiment, the chiller is in the general shape of a cylinder and the resilient sheet adopts the substantial form of a letter "S" when placed therein. Additionally or alternatively, the heat transfer means may comprise a heat conducting fin arrangement, formed of thermally-conductive material, sited, configured and disposed so as, when placed within the thin-walled vessel, to be in contact with the walls of the vessel. Such a fin arrangement can be configured to sub-divide the interior of the chiller into separate compartments for containing the adsorbent. The present invention also encompasses a fluid storage container when provided with a chiller as described above.

In order to enhance, i.e. accelerate or complete, the desorption process, (there usually being a considerable amount of adsorbed gas remaining when the adsorbent has been reduced to atmospheric pressure), or to accelerate it, the chiller may comprise a vessel containing a gas which is preferentially adsorbed by the adsorbent compared to the "cooling" gas. Helium, xenon or hydrogen are adsorbed by activated carbon in preference to carbon dioxide, for example, so that the use of helium as a flushing gas lowers the partial pressure of carbon-dioxide in the spaces surrounding the adsorbent, thereby inducing more carbon dioxide to desorb, thus providing further cooling, the arrangement being such that, preferably towards the end of the desorption process, the preferentially—adsorbed gas is released and is adsorbed by the adsorbent, which consequently desorbs the "cooling" gas.

The quantity of heat involved can be quite considerable and may provide one third as much cooling as was provided by reducing the pressure of the adsorbent to atmospheric. Such an arrangement not only enables full use of the main cooling gas, the preferentially—adsorbed gas preferably having a lower heat of adsorption than the main "cooling" gas, so that the exothermic adsorption heat is more than matched by the heat required by the endothermic desorption process, but also can be used to accelerate the main desorption process, and hence accelerate cooling of the fluid.

Figure 1A:
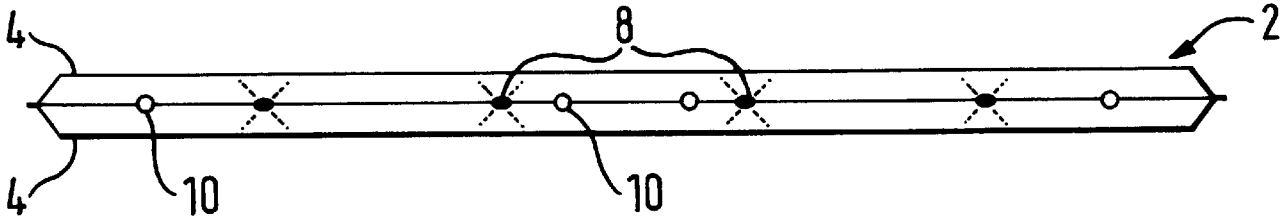
FIG. 1*a* is a side elevation view of the chiller of FIG. 1.
Figure 2:
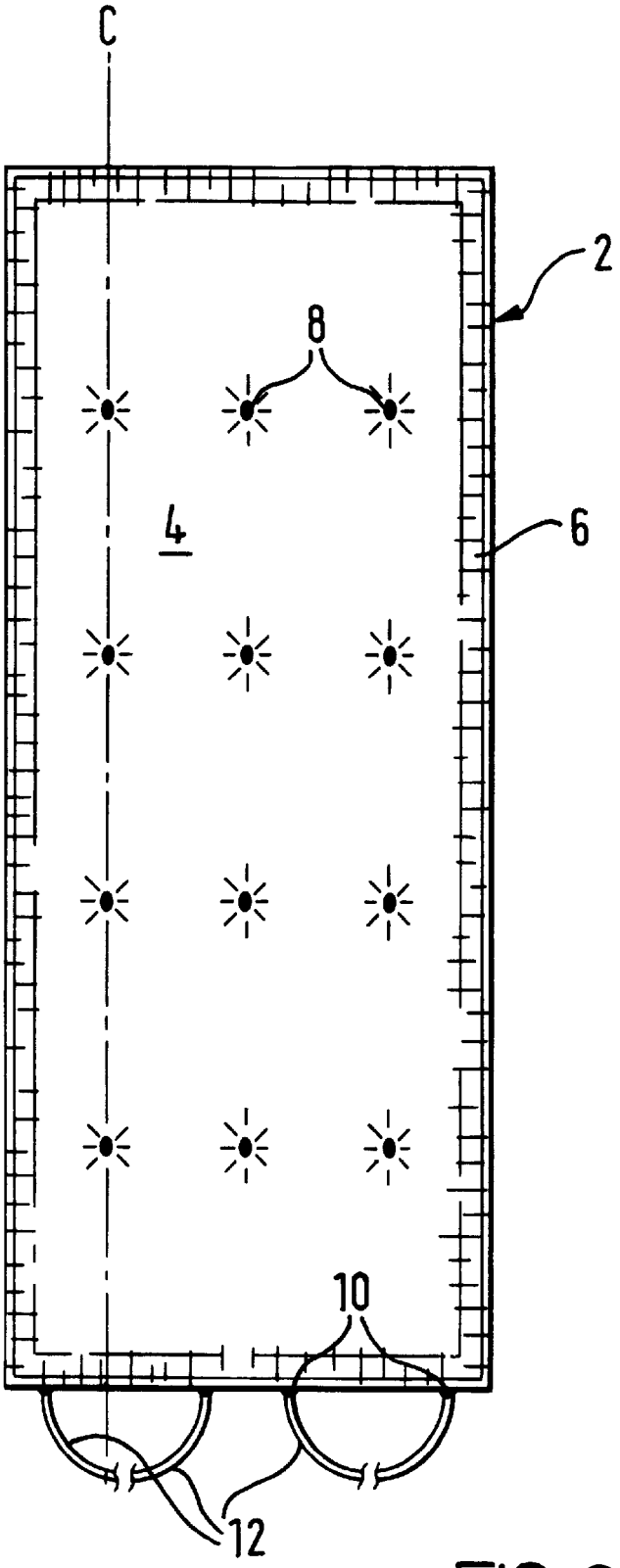
FIG. 2 is a diagrammatic view of a second embodiment of a chiller in accordance with the invention.

Turning to the drawings, the chillers shown in FIGS. 1, 1*a* and 2 comprise thin-walled vessels 2 for containing a suitable adsorbent, such as activated carbon, which receives and adsorbs a gas such as carbon dioxide. The chilling operation, which is not a feature of the present invention per se, is as follows: the chilling vessel 2 containing the adsorbent together with adsorbed gas is installed in a pressurized fluid storage container, which is then sealed; on opening the container, the pressure in the container (usually about 10 bar) is released, the drop in pressure triggering the desorption of the gas from the adsorbent. The desorbed gas is released to atmospheric pressure, the endothermic desorption process causing a significant drop in temperature of both the adsorbent and of the desorbed gas, which together act to chill the fluid.

The chiller vessels 2 of FIGS. 1, 1*a* and 2, which are for installation inside a fluid storage container (not shown) and in direct thermal contact with the fluid to be chilled, are formed of two thin rectangular sheets 4 of aluminum or aluminum alloy which are welded together along their peripheral edges 6. In addition, spot welds 8 are provided, joining the two sheets 4 together to create a "mattress" type configuration. This type of construction not only strengthens the vessel 2 but also provides an increase in surface area in the area adjacent each spot weld 8.

The configuration of the vessel 2 shown in FIGS. 1 and 2 advantageously combines a large surface area with the minimum volume required to contain sufficient adsorbent to give the desired chilling effect and freely to permit cooling gas adsorption and desorption. Minimizing the volume of the vessel 2 is important, so as not to displace too much fluid from the storage container within which it is to be placed. Maximizing the surface area of the vessel 2 is also important, so as to optimize chilling efficiency and to reduce the time taken to chill the fluid by the desired amount. Furthermore, increasing the surface area allows the vessel 2 to extend over as large a vertical distance as possible within the fluid storage container so that, when the fluid storage container is opened (which would normally then be in a position with the dispensing aperture uppermost), the downward current of fluid cooled by conduction from the upper portion of the vessel is maximized, thereby contributing to greater chilling efficiency.

The disposition of the spot welds 8 is such that, as shown in FIG. 2, they create crease lines C about which the vessel 2 can be folded, in Z-fold or concertina fashion for example, for ease of insertion of the vessel 2 into a fluid storage container (not shown), for example through the dispensing aperture thereof. The thin sheets 4 are sufficiently resilient as to tend to "open out" the folded vessel 2 after insertion, which improves the flow thereabout of fluid to be chilled and can suffice to hold, or wedge, the chiller vessel 2 in position within the fluid storage container.

Along one edge 6 of the chiller vessel 2 are a number of outlets 10 connected to elongate tubes 12. Gas released from the adsorbent within the vessel 2 leaves the vessel 2 via the outlets 10 and passes through the elongate tubes 12, and as it does so, chills the fluid. The elongate tubes 12 terminate at or adjacent the dispensing aperture (not shown) of the fluid storage container, and open to atmosphere on opening of the container for dispensing.

The elongate tubes 12 are sufficiently long as to extend through a substantial part of the fluid in the storage container, so as to maximize the chilling effect of the desorbed gas passing therethrough. Preferably, the elongate tubes 12 are sufficiently long as to permit the chiller vessel 2 to be installed in the storage container with the outlets 10 as far away from the container dispensing aperture (not shown) as possible.

Advantageously, the elongate tubes 12 are also long enough to be wrapped around the chiller vessel 2, thus temporarily holding the creased or folded vessel 2 tightly together as it is inserted within the storage container, whereafter the resilience of the thin sheets 4 acts so as to unfold or expand the vessel 2, thus holding it in place in the storage container and/or preventing it undesirably from passing through and/or obstructing the dispensing aperture during the dispensing operation.

The vessels 2 shown in FIGS. 1 and 2 are equally applicable for use with canned or bottled beverages. The vessel 2 of FIG. 1 would preferably be folded about the crease lines C running parallel to its shorter side, or curled up in a spiral about an axis parallel thereto, for insertion into a fluid storage container through the dispensing aperture thereof with the edge along which the outlets 10 are disposed foremost so that, once installed, that edge is most distant from the dispensing aperture. The vessel 2 of FIG. 2 is preferably folded about the crease lines C, or curled up in a spiral about an axis, parallel to the longer side of the vessel 2 for insertion into a fluid storage container.

The chiller described above provides numerous advantages including simplicity of design and ease of manufacture. It is easily insertable into existing fluid storage containers, even through the aperture therein may be quite small. Therefore, it may be inserted into standard containers without the need to change their design. Accordingly, the insertion of such chillers may be achieved without significant changes to existing production lines, for example, at the point immediately prior to the filling of the containers with fluid. The shape and configuration of the chiller also ensures that it is quick and efficient in use.

Figure 3A:
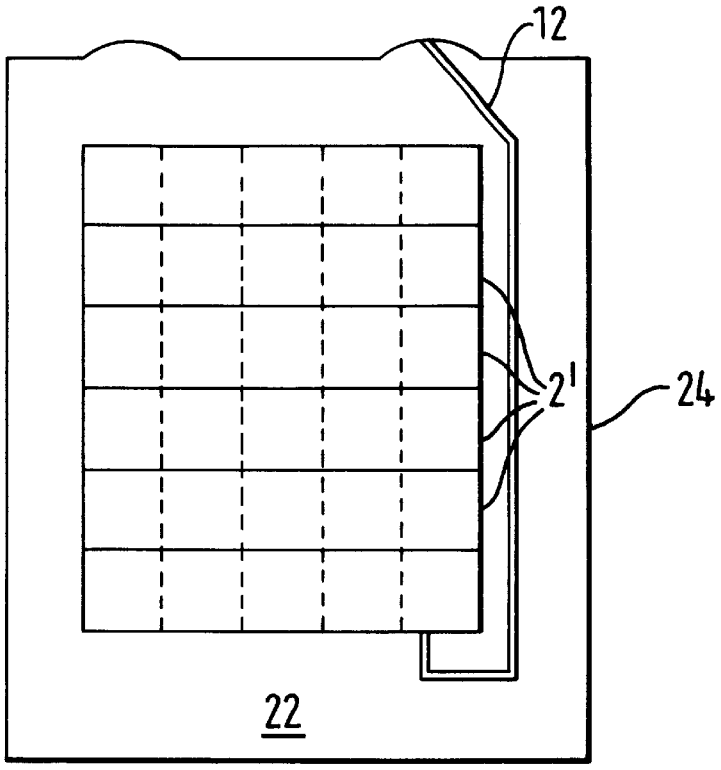
FIGS. 3*a*, 3*b* and 3*c* are diagrammatic views of a third embodiment of a chiller in accordance with the invention.
Figure 3B:
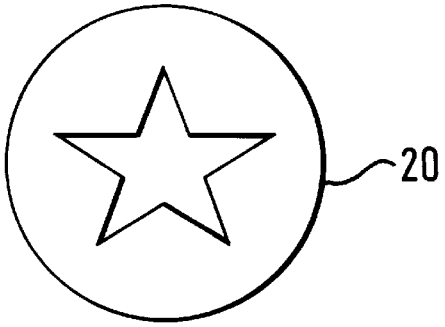
Figure 3C:
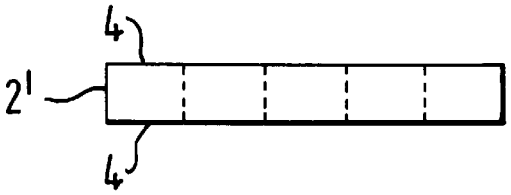

Having described two specific embodiments in accordance with this aspect of the present invention, those skilled in the art will appreciate that the invention encompasses several variations thereof. The chiller shown in FIG. 3*a*, for example, comprises a stack of chiller vessels 2' each of similar size and shape and each containing a similarly shaped and sized 'cake' of activated carbon adsorbent 20 (see FIG. 3*b*) each having a star-shaped central cut out. As shown in FIG. 3*c*, the chiller vessels 2' comprise discs of thin aluminum sheet 4 which are joined about their periphery so as to form a cylindrical vessel 2', the sheets 4 forming a heat conducting path between the adsorbent 20 and the fluid 22 in the container 24. Alternatively, a stack of adsorbent "cakes" can be contained in a single cylindrical vessel; in such an arrangement the upper and/or lower surface of each cake is grooved to permit free movement of desorbed gas toward the cylindrical wall of the vessel. Preferably, the cylindrical surface of each adsorbent "cake" is milled to allow easy passage of gas along the cylindrical vessel wall, and thus enhance heat transfer and the chilling efficiency.

The thin sheets 4 need not be rectangular as shown in FIGS. 1 and 2; they could instead by of any shape suitable to form any shape of vessel as appropriate for a particular application. The thin sheets could, therefore, be circular, cylindrical (i.e. forming a vessel in the shape of an open-ended cylinder) or any other shape. The present invention is not restricted to chillers comprising planar sheets 4 as drawn, and the word "sheets" should be construed accordingly. For example, the vessel may be formed by depositing a phenolic resin glass coating directly onto the adsorbent, which is of any suitable shape, e.g. as shown in FIGS. 3*a* to 3*c*). The number and disposition of outlets 10 need not be as shown in the drawings, since in some applications it may be desirable to provide only a single outlet and to provide a slow chill, as opposed to the faster chill allowed by multiple outlets, for example. The thin sheets 4, although conveniently of aluminum or aluminum alloy, may be formed of other materials and, as stated earlier, the present invention is particularly suited to cooling canned or bottled beverages but is not limited thereto. Thus, not only is the chiller of the present invention capable of chilling fluids other than beverages, and indeed substances other than fluids (solid or semi-solid foodstuffs, for example, or pharmaceuticals, chemicals or the like), it is also suitable with minimal modification for providing a heating effect (as those skilled in the art will readily appreciate). In light of the foregoing, the word "fluid" as used in the Claims should be construed accordingly.

Figure 4:
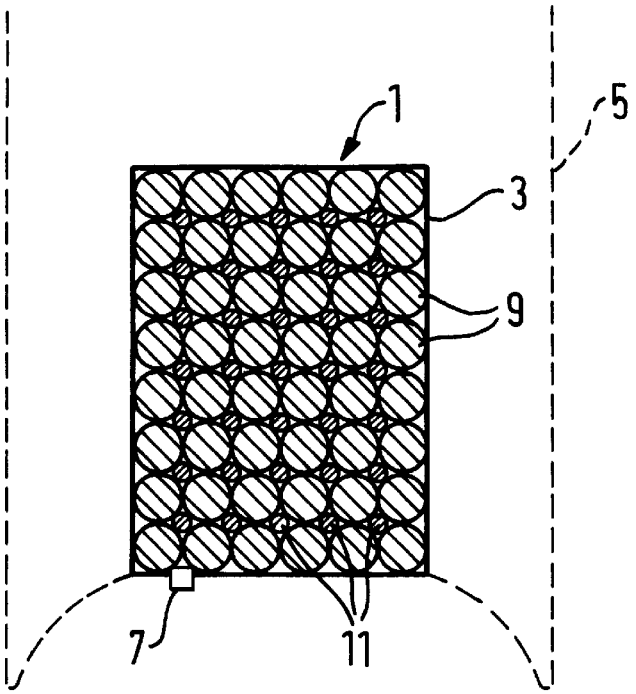
FIG. 4 is a schematic cross section view of a fourth embodiment of a chiller in accordance with the invention.

FIG. 4 shows a chiller 1 comprising a thin-walled, cylindrical vessel 3 formed of aluminum disposed within a typical beverage can shown, particularly, in phantom 5. The chiller 1 has a gas release valve 7 to allow gas to desorb from the adsorbent within the vessel 3 to produce the chilling effect. The thin walled vessel 3 contains particles of adsorbent 9, such as activated carbon, with substantially smaller particles of aluminum or aluminum alloy 11 interposed in the interstices between adjacent adsorbent particles 9 (for clarity, the sizes of the particles have been exaggerated, and the particles have been represented as substantially spherical). The carbon particles 9 and aluminum particles 11 are packed together so as to provide both a plurality of good heat transfer paths between the walls of the vessel 3 and the adsorbent in the middle thereof whilst maintaining a sufficiently porous structure as to allow desorption of gas therefrom.

Figure 5:
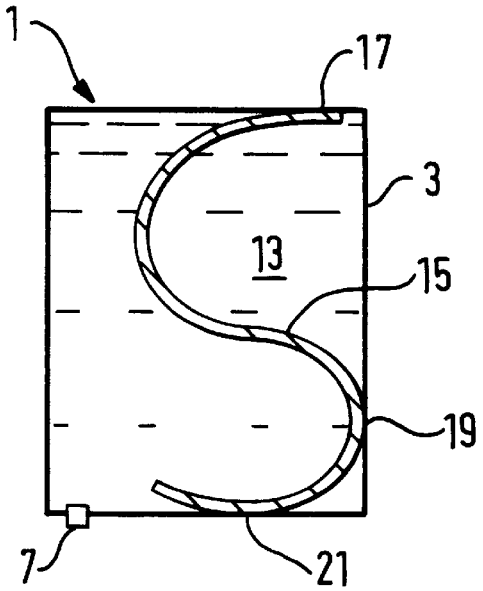
FIG. 5 is a schematic cross section view of a fifth embodiment of a chiller in accordance with the invention.

The chiller 1' illustrated in FIG. 5 also comprises a thin-walled vessel 3 having a gas release means 7 and containing a suitable adsorbent 13. In this embodiment, a resilient sheet of aluminum alloy 15 is packed into the vessel 3 so as to deform in a spring-like manner, here shown in the shape of a letter "S". Sheet, or spring 15 provides a heat transfer path between the adsorbent 13 in the central regions of the vessel 3 and the walls of the vessel 3, particularly at those regions where there is contact therebetween (17, 19, 21).

Figure 6A:
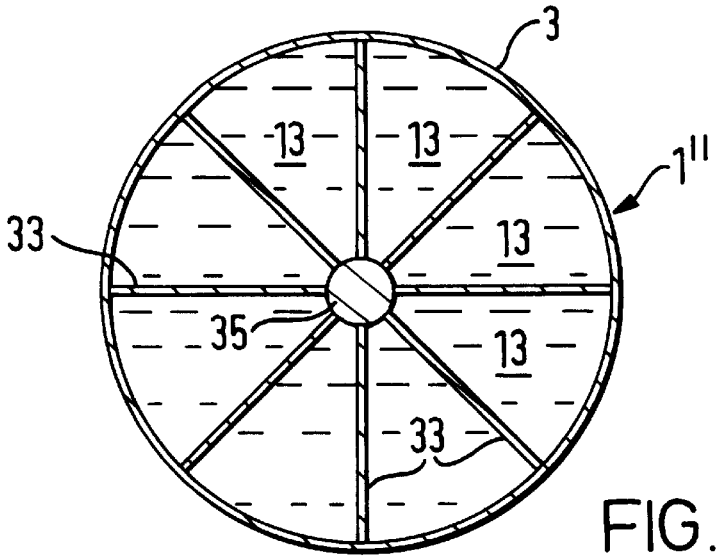
FIGS. 6*a* and 6*b* are schematic cross-sectional plan cut oblique views of a sixth embodiment of a chiller in accordance with the invention.
Figure 6B:
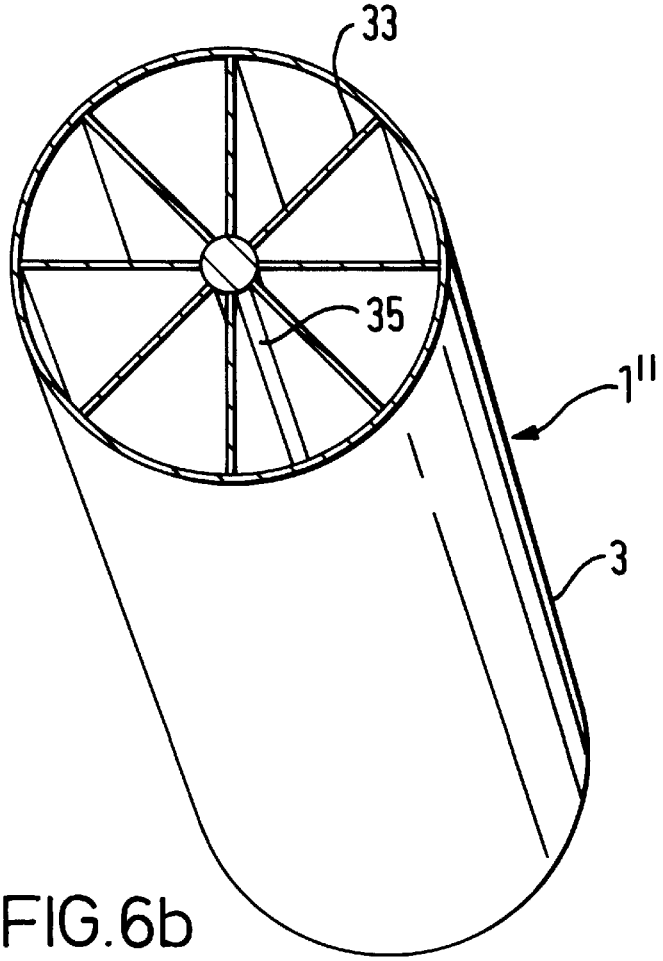

The chiller 1" shown in FIGS. 6*a* and 6*b* also comprises a thin-walled vessel 3 which is sub-divided by a number of fins 33 into a number of separate compartments, each containing adsorbent 13 (the number and disposition of the fins are a matter of straightforward design matters, and can be other than as illustrated). The fins 33 are each in contact with the walls of the vessel 3, and in at least thermal contact with each other along axis 35. As will be appreciated, FIG. 6 illustrates an essentially cylindrical chiller 1" (FIG. 6*a* being a plan view) and those skilled in the art will know that this could easily be formed by extrusion of aluminum or an alloy thereof, and would provide an inexpensive and thermally-efficient chiller, once cut into lengths, filled with adsorbent, the ends closed and suitable gas release means provided for selectively releasing an adsorbed gas.

Figure 7:
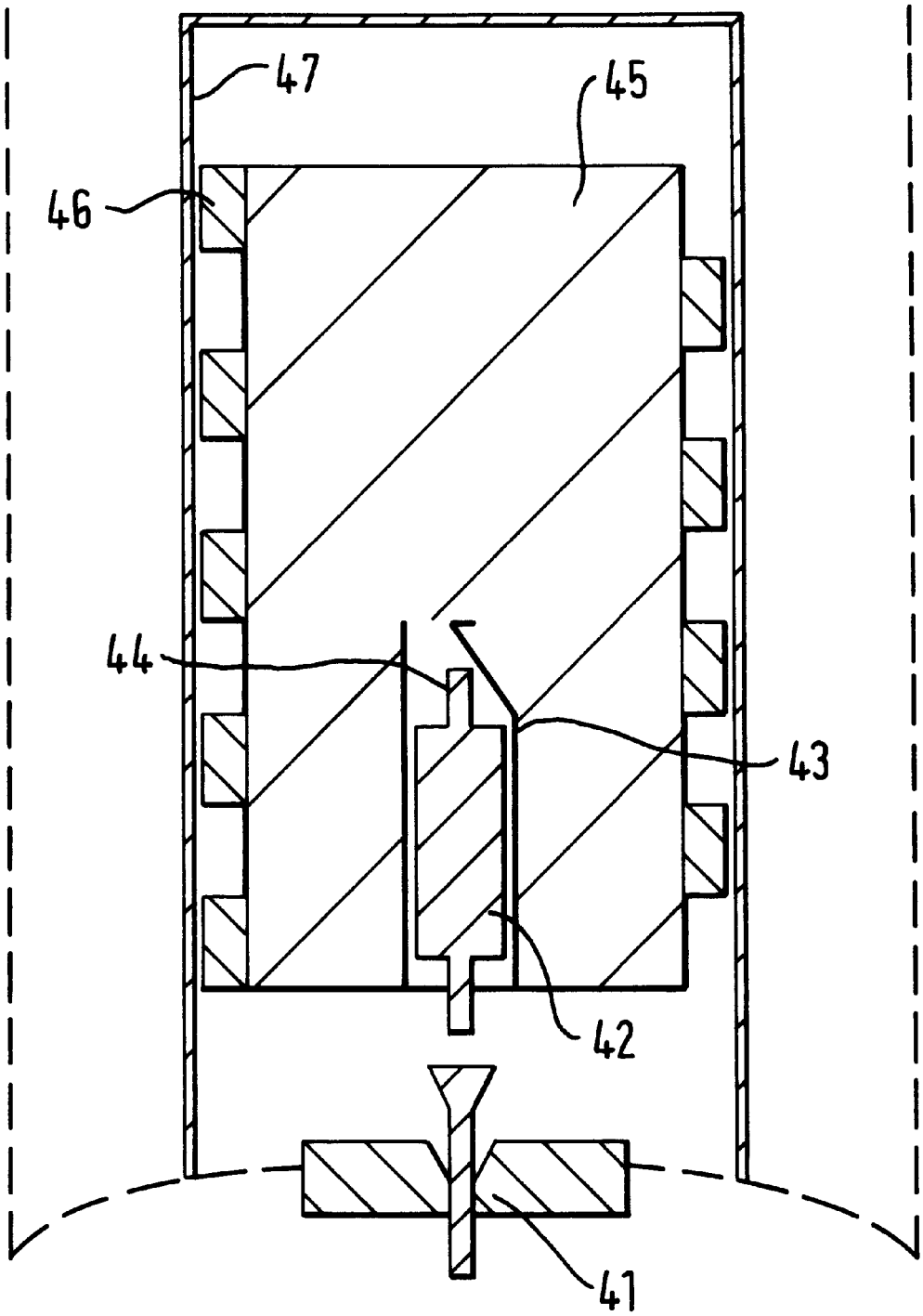
FIG. 7 is a schematic view of a chiller incorporating gas flushing means for additional cooling.

FIG. 7 shows a chiller 47 forming part of a beverage can (shown in phantom), in which actuation of a valve 41 at the base of the can pushes a cylinder 42 containing helium under pressure upwards, the cylinder 42 being located in a tube 43, the top of which is bent over to one side. The helium cylinder 42 has a frangible neck portion 44 adapted to snap off when brought into contact with the bent bit of the tube 43. Fracture of the neck portion 44 causes helium to be released into the activated carbon adsorbent 45, thereby causing the desorption of carbon dioxide. Blocks 46 represent a threaded extremity to the block of adsorbent, to make good thermal contact with the walls of the chiller 3 and to increase the gas path.

It will be apparent to those skilled in the art that the embodiments illustrated in FIGS. 4 to 7 are but illustrative of the general concepts of the present invention, namely of providing heat transfer means so as to transfer heat between the surface and the inner regions of the adsorbent within the chiller and of providing flushing means to promote further and/or accelerated desorption of the cooling gas, and that the simple embodiments described and illustrated above could be used either singly or in any combination. Furthermore, the chiller may be adapted to fit releasably within a specially shaped recess in a beverage container (i.e. not in direct thermal contact with the fluid) so that two or more such chillers may be used in succession to chill the beverage; accordingly it is not in fact essential that the vessel be adapted for placement in direct thermal contact with the fluid, rather this is a preferred feature.

We claim:

1. A chiller for chilling a quantity of fluid, said chiller containing an adsorbent for receiving and adsorbing under pressure a quantity of gas, the desorption of gas from the adsorbent causing a reduction in temperature of the adsorbent and adsorbate which acts to chill the fluid, wherein the chiller comprises at least one thin-walled vessel for placement in thermal contact with the fluid to be chilled, wherein each such vessel comprises two thin sheets of substantially similar size and shape, joined together around the peripheral edges thereof so as to form a cavity therebetween for containing the adsorbent, and a heat transfer means comprising a thermally-conductive material in direct thermal contact with the adsorbent and adapted to transfer heat between the walls of said vessel and the adsorbent therein.

2. A chiller in accordance with claim 1, wherein the sheets are planar.

3. A chiller in accordance with claim 1, wherein the sheets are resiliently deformable.

4. A chiller in accordance with claim 1, wherein the sheets are made of aluminum or an alloy thereof.

5. A chiller in accordance with claim 1, wherein the sheets are additionally joined together at one or more points other than around the peripheral edges thereof.

6. A chiller in accordance with claim 5, wherein the said points are aligned so as to form crease lines about which the vessel may be folded.

7. A chiller in accordance with claim 1, additionally comprising one or more elongate tubes, each such tube communicating at one end with said vessel cavity and the adsorbent therein, thereby to create a passageway for adsorbed gas to pass through as it is released from the adsorbent.

8. A chiller in accordance with claim 7, wherein each elongate tube is substantially longer than the maximum dimension of the vessel.

9. A chiller in accordance with claim 1, additionally comprising one or more thermally-conductive fins extending outwardly from at least one of said sheets.

10. A chiller in accordance with claim 1 comprising a plurality of such vessels arranged in a stack.

11. A chiller in accordance with claim 1, wherein both the adsorbent and the heat transfer means are in compressed particulate form, the heat transfer particles being of substantially different average size to the adsorbent particles.

12. A chiller in accordance with claim 11, wherein the heat transfer particles are substantially evenly dispersed through the adsorbent particles.

13. A chiller in accordance with claim 1 wherein the heat transfer means comprises a resilient planar sheet of thermally-conductive material contiguous with the walls of the vessel over at least a part of its surface.

14. A chiller in accordance with claim 13, wherein said resilient sheet within the vessel is substantially in the form of the letter "S".

15. A chiller in accordance with claim 1, wherein the heat transfer means comprise a fin arrangement of thermally-conductive material sized, configured and disposed within the vessel so as to provide at least two points of contact with the walls of the vessel.

16. A chiller in accordance with claim 15, wherein the fin arrangement is sized, configured and disposed within the vessel so as to substantially sub-divide the interior of the vessel into separate compartments containing the adsorbent.

17. A chiller in accordance with claim 1, wherein the thermally-conductive material is aluminum or an alloy thereof.

18. A chiller in accordance with claim 1, additionally comprising means for releasing a second gas into the adsorbent, the second gas being more preferentially adsorbed by the adsorbent than said gas, thereby to enhance the desorption of said gas.

19. A chiller in accordance with claim 18, wherein said gas, said second gases and the adsorbent are such that the specific heat of desorption of said gas is not less than the specific heat of adsorption of the second gas.

20. A chiller for chilling a quantity of fluid comprising an adsorbent for receiving and adsorbing under pressure a quantity of gas wherein the desorption of gas from the adsorbent causes a reduction in temperature of the adsorbent and of the desorbed gas which temperature reduction acts to chill the fluid, at least one thin-walled vessel containing the adsorbents and a heat transfer means in direct contact with the adsorbent and adapted to transfer heat between the vessel walls and the adsorbent therein.

21. A chiller according to claim 20 wherein the heat transfer means is in particulate form.

22. A chiller according to claim 21 wherein the adsorbent comprises compressed particulates.

23. A chiller according to claim 22 wherein the heat transfer particulates are of substantially different average size to the adsorbent particles.

24. A chiller according to claim 22 wherein the heat transfer particles are substantially evenly dispersed through the adsorbent.

* * * * *